US007608573B1

(12) United States Patent
Scheuing et al.

(10) Patent No.: US 7,608,573 B1
(45) **Date of Patent: *Oct. 27, 2009**

(54) NATURAL HEAVY DUTY CLEANERS

(75) Inventors: David R. Scheuing, Danville, CA (US); Nancy Ann Falk, Livermore, CA (US); David Jackson Lestage, Livermore, CA (US); Erika Szekeres, San Ramon, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/198,677

(22) Filed: Aug. 26, 2008

(51) Int. Cl.

| | |
|---|---|
| ***C11D 1/12*** | (2006.01) |
| ***C11D 1/75*** | (2006.01) |
| ***C11D 3/18*** | (2006.01) |
| ***C11D 3/22*** | (2006.01) |
| ***C11D 3/43*** | (2006.01) |

(52) U.S. Cl. ..... 510/331; 510/340; 510/342; 510/350; 510/351; 510/360; 510/426; 510/433; 510/437; 510/474; 510/481; 510/492; 510/499

(58) Field of Classification Search ..... 510/331, 510/340, 342, 350, 351, 360, 426, 433, 437, 510/474, 481, 492, 499

See application file for complete search history.

(56) References Cited

U.S. PATENT DOCUMENTS

| | | | | |
|---|---|---|---|---|
| 6,004,915 | A | 12/1999 | Elliot | |
| 6,060,440 | A | 5/2000 | Sackariasen | |
| 6,117,820 | A | 9/2000 | Cutler et al. | |
| 6,121,228 | A | 9/2000 | Drapier | |
| 6,537,960 | B1 | 3/2003 | Ruhr et al. | |
| 6,686,323 | B2 | 2/2004 | Nilsson et al. | |
| 6,759,382 | B2 * | 7/2004 | Ahmed | 510/424 |
| 2005/0233938 | A1 | 10/2005 | Delplancke | |
| 2006/0172889 | A1 | 8/2006 | Barnes et al. | |
| 2006/0258541 | A1 | 11/2006 | Crews | |

FOREIGN PATENT DOCUMENTS

| | | |
|---|---|---|
| WO | WO 00/49095 | 8/2000 |

* cited by examiner

*Primary Examiner*—Brian P Mruk
(74) *Attorney, Agent, or Firm*—Alok Goel

(57) ABSTRACT

A cleaning composition with a limited number of natural ingredients contains an anionic surfactant, a nonionic surfactant, a solvent and a short chain syndetic. The cleaning composition can be used to clean laundry, soft surfaces, and hard surfaces and cleans as well or better than commercial compositions containing synthetically derived cleaning agents.

25 Claims, No Drawings

NATURAL HEAVY DUTY CLEANERS

BACKGROUND OF THE INVENTION

1. Field of the Invention

The present invention relates generally to naturally based cleaners, especially heavy duty cleaners, such as laundry detergents and soil and stain removers.

2. Description of the Related Art

Cleaning formulations have progressed and created a large chemical industry devoted to developing new synthetic surfactants and solvents to achieve ever improving cleaning compositions for the consumer. Because of a desire to use renewable resources, natural based cleaners are gaining increasing interest. Most of these cleaners contain only some natural ingredients. One difficulty in formulating natural based cleaners is achieving acceptable consumer performance with a limited number of natural components compared to highly developed formulations using synthetic surfactants and solvents.

Typical cleaning formulations require multiple surfactants, solvents, and builder combinations to achieve adequate consumer performance. Because of the increased cost of synthetic sources for cleaning agents and a concern for the environment, there is renewed focus on using materials that are naturally sourced.

For example, U.S. Pat. No. 6,759,382 to Ahmed discloses a concentrated liquid detergent composition containing a primary surfactant system alkylbenzene sulfonate and another sulfate or sulfonate and a secondary surfactant system containing an α-sulfomethyl ester or alkyl polyglucoside, where the alkyl polyglucoside is a $C_8$ to $C_{16}$ alkylpolyglucoside, a $C_8$ to $C_{10}$ alkylpolyglucoside, a $C_8$ to $C_{14}$ alkylpolyglucoside, a $C_{12}$ to $C_{14}$ alkylpolyglucoside, or a $C_{12}$ to $C_{16}$ alkylpolyglucoside. U.S. Pat. No. 6,686,323 to Nilsson et al. discloses $C_6$, $C_8$ and $C_{10}$ alkylpolyglucosides as surfactant for mud removal in oil drilling. U.S. Pat. No. 6,117,820 to Cutler et al. discloses agricultural formulations containing $C_8$ to $C_{10}$ alkylpolyglucosides, $C_9$ to $C_{11}$ alkylpolyglucosides, and 2-ethyl-1-hexylglucoside. U.S. Pat. App. 20060172889 to Barnes et al. discloses agricultural formulations containing $C_7$ to $C_{18}$ alkylpolyglucosides. U.S. Pat. No. 6,537,960 to Ruhr et al. discloses $C_6$ and $C_8$ alkylpolyglucosides in highly alkaline formulations with amine oxides and alcohol alkoxylates. PCT App. WO 00/49095 to Landeweer et al. discloses $C_6$ to $C_{10}$ alkylpolyglucosides with glycol ethers such as butyl diglycol.

Prior art compositions do not combine effective cleaning with a minimum number of ingredients, especially with natural ingredients. It is therefore an object of the present invention to provide a cleaning composition that overcomes the disadvantages and shortcomings associated with prior art cleaning compositions.

SUMMARY OF THE INVENTION

In accordance with the above objects and those that will be mentioned and will become apparent below, one aspect of the present invention comprises a natural heavy duty cleaning composition consisting essentially of an anionic surfactant selected from the group consisting of sodium lauryl sulfate, sodium alkyl α-sulfomethyl ester, and combinations thereof, a hydrophilic syndetic selected from the group consisting of C6 alkylpolyglucoside, C6 to C8 alkylpolyglucoside, C8 alkyl polyglucoside and combinations thereof, a nonionic surfactant selected from the group consisting of C12 amine oxide, C12-14 amine oxide, C12 amidoamine oxide, C12-14 amidoamine oxide, alkylpolyglucosides having chain lengths greater than C8, and combinations thereof, a solvent selected from the group consisting of propylene glycol, 1,3-propanediol, ethanol, sorbitol, glycerol and combinations thereof, a hydrophobic syndetic selected from a fatty acid; pH 7-13; optionally an organic chelating agent from the group consisting of 2-hydroxyacids, 2-hydroxyacid derivatives, glutamic acid, glutamic acid derivatives, and mixtures thereof, and optional ingredients selected from glycerol, pH adjusting agents, calcium salts, boric acid or borate, enzymes, dyes, colorants, fragrances, preservatives, fluorescent whitening agents, blueing agents, defoamers, bleaches, and thickeners.

In accordance with the above objects and those that will be mentioned and will become apparent below, another aspect of the present invention comprises a natural heavy duty cleaning composition consisting essentially of an anionic surfactant selected from the group consisting of a fatty alcohol sulfate, an alkyl α-sulfomethyl ester, and combinations thereof, a hydrophilic syndetic selected from the group consisting of C6 alkylpolyglucoside, C6 to C8 alkylpolyglucoside, C8 alkylpolyglucoside, C6 to C8 alkyl sulfate and combinations thereof, a nonionic surfactant selected from the group consisting of amide oxide, alkoxylated amine, alkylpolyglucoside having chain lengths from C8 to C20, sarcosinate, tauride, betaine, sulfobetaine, alkyldiethanolamide, alkylethanolamide, and combinations thereof, a solvent selected from the group consisting of propylene glycol, 1,3-propanediol, ethanol, sorbitol, glycerol and combinations thereof, a hydrophobic syndetic selected from the group consisting of a fatty acid, a fatty alcohol, a sterol, a sorbitan fatty acid ester, a glycerol fatty acid ester, and combinations thereof, optionally an organic chelating agent from the group consisting of 2-hydroxyacids, 2-hydroxyacid derivatives, glutamic acid, glutamic acid derivatives, and mixtures thereof, and optional ingredients selected from glycerol, pH adjusting agents, alkanolamines, calcium salts, boric acid, enzymes, dyes, colorants, fragrances, preservatives, fluorescent whitening agents, blueing agents, defoamers, bleaches, thickeners.

In accordance with the above objects and those that will be mentioned and will become apparent below, another aspect of the present invention comprises a natural heavy duty cleaning composition comprising an anionic surfactant selected from the group consisting of sodium lauryl sulfate, sodium alkyl α-sulfomethyl ester, and combinations thereof, a hydrophilic syndetic selected from the group consisting of C6 alkylpolyglucoside, C6 to C8 alkylpolyglucoside, C8 alkylpolyglucoside, C6 to C8 alkyl sulfate and combinations thereof, a nonionic surfactant selected from the group consisting of amide oxide, alkylpolyglucoside having chain lengths from C8 to C16, and combinations thereof, a solvent selected from the group consisting of propylene glycol, 1,3-propanediol, ethanol, sorbitol, glycerol and combinations thereof, and a hydrophobic syndetic selected from the group consisting of a fatty acid, a fatty alcohol, a sterol, a sorbitan fatty acid ester, a glycerol fatty acid ester, and combinations thereof.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

The term "syndetic" (meaning to join or link together, as in mixing water and oil), as used herein, is a relatively weak amphiphile which exhibits a significant ability to adsorb at an oil-water interface (from either the water phase, hence a "hydrophilic syndetic", or from the oil phase, hence a "hydrophobic syndetic") only when the interface already bears an adsorbed layer of an ordinary surfactant or mixture of surfactants. Adsorption of syndetics at oil-water interfaces is thought to affect the spacing and order of the adsorbed ordinary surfactants in a manner that is highly beneficial to the production of very low oil-water interfacial tensions, which in turn increases the solubilization of oils and/or the removal of oils from solid surfaces.

The term "comprising", which is synonymous with "including," "containing," or "characterized by," is inclusive or open-ended and does not exclude additional, unrecited elements or method steps. See MPEP 2111.03. See, e.g., *Mars Inc. v. H.J. Heinz Co.,* 377 F.3d 1369, 1376, 71 USPQ2d 1837, 1843 (Fed. Cir. 2004) ("like the term 'comprising,' the terms 'containing' and 'mixture' are open-ended."). *Invitrogen Corp. v. Biocrest Mfg., L.P.,* 327 F.3d 1364, 1368, 66 USPQ2d 1631, 1634 (Fed. Cir. 2003) ("The transition 'comprising' in a method claim indicates that the claim is open-ended and allows for additional steps."); *Genentech, Inc. v. Chiron Corp.,* 112 F.3d 495, 501, 42 USPQ2d 1608, 1613 (Fed. Cir. 1997) See MPEP 2111.03. ("Comprising" is a term of art used in claim language which means that the named elements are essential, but other elements may be added and still form a construct within the scope of the claim); *Moleculon Research Corp. v. CBS, Inc.,* 793 F.2d 1261, 229 USPQ 805 (Fed. Cir. 1986); *In re Baxter,* 656 F.2d 679, 686, 210 USPQ 795, 803 (CCPA 1981); *Ex parte Davis,* 80 USPQ 448, 450 (Bd. App. 1948). See MPEP 2111.03.

The term "consisting essentially of" as used herein, limits the scope of a claim to the specified materials or steps "and those that do not materially affect the basic and novel characteristic(s)" of the claimed invention. *In re Herz,* 537 F.2d 549, 551-52, 190 USPQ 461, 463 (CCPA 1976) (emphasis in original).

Syndetics Technology

The compositions can contain a primary anionic surfactant, a primary nonionic surfactant, a hydrophilic syndetic, and a hydrophobic syndetic. Alternately, the compositions can contain a primary nonionic surfactant, a hydrophilic syndetic, and a hydrophobic syndetic. One key component of the invention is the short-chain hydrophilic syndetic, which can interact with the other components to give very low interfacial tension (IFT). The short-chain hydrophilic syndetic is preferably a $C_6$ alkyl polyglucoside, a $C_6$ to $C_8$ alkyl polyglucoside, or a $C_8$ alkyl polyglucoside. Alternative suitable hydrophilic syndetics are $C_6$ alkyl sulfate or $C_6$ to $C_8$ alkyl sulfate.

Primary Anionic Surfactant

In one embodiment of the invention the primary anionic surfactant is an fatty alcohol sulfate having a $C_{12}$ or longer chain, for example sodium lauryl sulfate. Typical alkyl sulfate surfactants are water soluble salts or acids of the formula $ROSO_3$ M wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperidinium cations and quaternary ammonium cations derived from alkylamines such as ethylamine, diethylamine, triethylamine, and mixtures thereof, and the like). Typically, alkyl chains of include $C_{12}$-$C_{16}$ alkyl and $C_{16-18}$ alkyl chains.

In another embodiment of the present invention, the anionic surfactant is an α*sulfomethyl ester (MES). In a suitable embodiment, the α-sulfomethyl ester salt is a α-sulfomethyl ester of a fatty acid and can be chosen from a $C_{12}$-$C_{18}$ sodium methyl α-sulfomethyl ester and a $C_{12}$-$C_{18}$ disodium α-sulfo fatty acid salt. Because more than one α-sulfomethyl ester may be present, the present invention contemplates the use of both sodium methyl α-sulfomethyl ester and the disodium α-sulfo fatty acid salt in the secondary surfactant system. Commercially available sodium α-sulfomethyl esters that may be used in accordance with the present invention include ALPHA-STEP® ML-40 and ALPHA-STEP® MC-48, both sold by Stepan Company. A mixture of sodium methyl 2-sulfolaurate and disodium 2-sulfolaurate is preferred.

Other anionic materials include alkanoyl sarcosinates corresponding to the formula $R^1CON(CH_3)—CH_2CH_2—CO_2M$ wherein $R^1$ is a saturated or unsaturated, branched or unbranched alkyl or alkenyl group of about 10 to about 20 carbon atoms, and M is a water-soluble cation. Nonlimiting examples of which include sodium lauroyl sarcosinate, sodium cocoyl sarcosinate, and ammonium lauroyl sarcosinate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting, examples of which include sodium cocoyl lactylate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting examples of which include sodium cocoyl lactylate. Other anionic materials include acyl glutamates corresponding to the formula $R^1CO—N(COOH)—CH_2CH_2—CO_2M$ wherein $R^1$ is a saturated or unsaturated, branched or unbranched alkyl or alkenyl group of about 8 to about 24 carbon atoms, and M is a water-soluble cation. Nonlimiting examples of which include sodium lauroyl glutamate and sodium cocoyl glutamate. Other anionic materials include the carboxylates, nonlimiting examples of which include sodium lauroyl carboxylate, sodium cocoyl carboxylate, and ammonium lauroyl carboxylate. Also useful are taurates which are based on taurine, which is also known as 2-aminoethanesulfonic acid. Examples of taurates include N-alkyltaurines such as the one prepared by reacting dodecylamine with sodium isethionate according to the teaching of U.S. Pat. No. 2,658,072 which is incorporated herein by reference in its entirety. Other examples based of taurine include the acyl taurines formed by the reaction of n-methyl taurine with fatty acids (having from about 8 to about 24 carbon atoms). Other anionic surfactants include glutamates, such as sodium or triethylammonium cocoyl glutamate, and glycinates, such as potassium cocoyl glycinate.

Besides sodium other salts can include, for example, potassium, ammonium, and substituted ammonium salts such as mono-, di- and tri-ethanolamine salts of the anionic surfactant. The anionic surfactant is typically present in 0.1 to 50%, or 0.1 to 30%, or 0.1 to 20%, or 1 to 20%, 3 to 20%.

Primary Nonionic Surfactants

In one embodiment of the invention the cleaning compositions can contain amine oxides, amidoamine oxides, alkanol amides, and fatty acid amines surfactants. A suitable alkanolamide is a lower alkanolamide of a higher alkanoic acid, for example a mono-alkanolamide chosen from lauryl/myristic monoethanolamide and coco monoethanolamide from Stepan Company®. Suitable amine oxides include those compounds having the formula $R^3(OR^4)_xNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof-, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are C10-C18 alkyl dimethylamine oxide, and C10-18 acylamido alkyl dimethylamine oxide. A suitable example of an alkyl amphodicarboxylic acid is Miranol™ C2M Conc. manufactured by Miranol, Inc., Dayton, N.J.

Other suitable surfactants include mono-alkoxylated amine surfactants preferably of the general formula: $R^1R^2R^3N^+ApR^4X^-$ wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8. Preferably the $ApR^4$ group in the formula has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2—OH$, $—CH_2CH_2CH_2—OH$, $—CH_2CH(CH_3)—OH$ and $—CH(CH_3)CH_2—OH$, with $—CH_2CH_2—OH$ being particularly preferred. Preferred $R^1$ groups are linear alkyl groups. Linear $R^1$ groups having from 8 to 14 carbon atoms are preferred.

In one embodiment of the invention the cleaning compositions contain one or more alkyl polyglucoside surfactants. The alkyl polyglucoside surfactant preferably has a naturally derived alkyl substituent, such as coconut fatty alcohol or a distilled cut of a natural fatty alcohol. The alkyl polyglucoside is preferably made from renewable resources and preferably has no petroleum derived components, such as ethoxylate or propoxylate. Any additional alkyl polyglucoside can be a secondary hydrophilic syndetic, such as a $C_8$ to $C_{16}$ alkylpolyglucoside, a $C_8$ to $C_{10}$ alkylpolyglucoside, a $C_8$ to $C_{14}$ alkylpolyglucoside, a $C_{12}$ to $C_{14}$ alkylpolyglucoside, or a $C_{12}$ to $C_{16}$ alkylpolyglucoside, for example.

Suitable alkyl polyglucoside surfactants are the alkylpolysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g., a polyglycoside (polyglucoside), hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkylglucoside surfactants include, for example, APG 425® (a coconut alkyl polyglucoside having naturally derived components available from Cognis Corporation), APG 325® (a $C_9$-$C_{11}$ alkyl polyglucoside available from Cognis Corporation), APG 625® (a $C_{10}$-$C_{16}$ alkyl polyglucoside available from Cognis Corporation), Dow Triton® CG110 (a $C_8$-$C_{10}$ alkyl polyglucoside available from Dow Chemical Company), AG6202® (a $C_8$ alkyl polyglucoside available from Akzo Nobel) and Alkadet 15® (a $C_8$-$C_{10}$ alkyl polyglucoside available from Huntsman Corporation). A C8 to C10 alkylpolygluco-side includes alkylpolyglucosides wherein the alkyl group is substantially C8 alkyl, substantially C10 alkyl, or a mixture of substantially C8 and C10 alkyl. Suitably, the alkyl polyglucoside is present in the cleaning composition in an amount ranging from about 0.01 to about 30 weight percent, or 0.1 to 30 weight percent, or 10 to 30 weight percent, or 1 to 5 weight percent, or 2 to 5 weight percent, or 0.5 to 5 weight percent, or 0.5 to 4 weight percent, or 0.5 to 3 weight percent, or 0.5 to 2.0 weight percent, or 0.1 to 0.5 weight percent, or 0.1 to 1.0 weight percent, or 0.1 to 2.0 weight percent, or 0.1 to 3.0 weight percent, or 0.1 to 4.0 weight percent, or greater than 2 weight percent, or greater than 3 weight percent.

The compositions can contain nonionic amphoteric surfactants such as alkyl betaines, alkyl sultaines, alkyl amphoacetates, alkyl amphodiacetates, alkyl amphopropionates, and alkyl amphodipropionates. Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference.

The cleaning compositions preferably have an absence of other nonionic surfactants, especially petroleum derived nonionic surfactants, such as nonionics based on synthetic alcohols or ethoxylates. The cleaning compositions preferably have an absence of other surfactants or substantially no additional surfactant, such as anionic, nonionic, cationic, and amphoteric surfactants. Many other surfactants, such as nonionic esters, anionic sulfates, and amphoteric sarcosinates are unstable in the inventive compositions.

Hydrophilic Syndetic

In one embodiment of the invention the cleaning compositions contain one or more hydrophilic syndetics. Suitable short-chain hydrophilic syndetics include a $C_6$ alkyl polyglucoside, such as AG6206®, or a $C_6$ to $C_8$ alkyl polyglucoside, such as AG6202® from Akzo-Nobel®. Other suitable short-chain hydrophilic syndetics include C6 to C8 alkyl sulfate, including hexyl sulfate, octyl sulfate, and 2-ethylhexyl sulfate. The alkyl chains are preferably straight chains and derived from natural oils, rather than branched chains, such as 2-ethylhexyl. These hydrophilic syndetics provide surprisingly unique interactions with anionic surfactants and nonionic surfactants to allow the compositions to go to low interfacial tensions comparable to compositions based on synthetic petrochemical feedstocks.

Suitably, hydrophilic syndetics are present in the cleaning composition in an amount ranging from about 0.01 to about 10 weight percent, or 0.01 to about 5 weight percent, 0.01 to 2 weight percent, or 0.01 to 1 weight percent, or 0.01 to 0.5 weight percent, or 0.01 to 0.20 weight percent.

Hydrophobic Syndetic

In one embodiment of the invention the cleaning compositions contain one or more hydrophobic syndetics. Preferred hydrophobic syndetics are fatty acids, such as oleic or palmitic acid. A fatty acid is a carboxylic acid that is often with a long unbranched aliphatic tail (chain), which is saturated or unsaturated. Fatty acids are aliphatic monocarboxylic acids, derived from, or contained in esterified form in an animal or vegetable fat, oil or wax. Natural fatty acids commonly have a chain of 4 to 28 carbons (usually unbranched and even numbered), which may be saturated or unsaturated. Saturated fatty acids do not contain any double bonds or other functional groups along the chain. The term "saturated" refers to hydrogen, in that all carbons (apart from the carboxylic acid [—COOH] group) contain as many hydrogens as possible. In contrast to saturated fatty acids, unsaturated fatty acids contain double bonds. Examples of fatty acids that can be used in the present invention, include but are not limited to, butyric acid, caproic acid, caprylic acid, capric acid, lauric acid, myristic acid, palmitic acid, stearic acid, arachdic acid, behenic acid, lignoceric acid, myristoleic acid, palmitoleic acid, oleic acid, linoleic acid, alpha-linoleic acid, arachidonic acid, eicosapentaenoic acid, erucic acid, docosahexaenoic acid or mixtures thereof. The fatty acid suitably has a primary chain length (the predominate chain length) from C10 to C18.

Other suitable hydrophobic syndetics are glycerol and sorbitan fatty acid esters. The glyceryl alkyl or alkenyl ester (co-surfactant (iii)) is preferably a monoester of a C8-C22 carboxylic acid with glycerol. A suitable example is CITHROL GML® which is glyceryl monolaurate. The sorbitan alkyl or alkenyl ester preferably contains from 8 to 22 carbon atoms in the ester group, an especially suitable sorbitan ester is a sorbitan monolaurate such as that available under the trade name SPAN 20®. Another suitable sorbitan ester is SPAN 80®. Other suitable hydrophobic syndetics are fatty alcohols, which are the reduction product of fatty acids. Other suitable hydrophobic syndetics are sterols, especially plant sterols such as campesterol, sitosterol, stigmasterol, lanosterol, avenasterol, and cycloartenol.

Suitably, hydrophobic syndetics are present in the cleaning composition in an amount ranging from about 0.01 to about 10 weight percent, or 0.01 to about 5 weight percent, 0.01 to 2 weight percent, or 0.01 to 1 weight percent, or 0.01 to 0.5 weight percent, or 0.01 to 0.20 weight percent.

Organic Chelating Agents

One aspect of the invention is a 2-hydroxycarboxylic acid or mixture of 2-hydroxycarboxylic acids or derivatives. Examples of 2-hydroxycarboxylic acids include tartaric acid, citric acid, malic acid, mandelic acid, glycolic acid, and lactic acid. 2-Hydroxycarboxylic acids also include polymeric forms of 2-hydroxycarboxylic acid, such as polylactic acid. Since other organic builders are not substantially present, significant amounts of 2-hydroxycarboxylic acids are required.

Suitable amino carboxylates chelating agents include ethanol-diglycines, disodium cocoyl glutamatic acid, and methyl glycine di-acetic acid (MGDA), both in their acid form, or in their alkali metal, ammonium, and substituted ammonium salt forms. Further carboxylate chelating agents for use herein include salicylic acid, aspartic acid, glutamic acid, glycine, malonic acid or mixtures and derivatives thereof.

The compositions container substantially no additional organic chelating agents. Suitable compositions comprise chelating agents in concentrations of 0.5 to 10% by weight, or 0.5 to 5% by weight, or 0.5 to 4% by weight, or 0.5 to 3% by weight, or 0.5 to 2% by weight.

Solvent

The cleaning compositions can contain limited amounts of organic solvents, such as ethanol, sorbitol, glycerol, propylene glycol, glycerol, and 1,3-propanediol, for example less than 10%, or less than 5%. The compositions preferably contain solvents from natural sources rather than solvents from synthetic petrochemical sources, such as glycol ethers, hydrocarbons, and polyalkylene glycols. The compositions should be free of other organic solvents (or only trace amounts of less than 0.5% or 0.1%) including, but are not limited to, other $C_{1-6}$ alkanols, other $C_{1-6}$ diols, $C_{1-10}$ alkyl ethers of alkylene glycols, $C_{3-24}$ alkylene glycol ethers, polyalkylene glycols, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed.

Water

When the composition is an aqueous composition, water can be a predominant ingredient. The water should be present at a level of less than 90 weight percent, more preferably less than about 80 weight percent, and most preferably, less than about 70 weight percent. Deionized or filtered water is preferred.

Fragrances

The cleaning compositions can contain fragrances, especially fragrances containing essential oils, and especially fragrances containing d-limonene or lemon oil; or natural essential oils or fragrances containing d-limonene or lemon oil. Lemon oil or d-limonene helps the cleaning performance characteristics of the cleaning composition to allow suitable consumer performance with natural ingredients and a minimum of ingredients. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, the fragrance contains essential oil or lemon oil or d-limonene in the cleaning composition in an amount ranging from about 0.01 to about 0.50 weight percent, or 0.01 to 0.40 weight percent, or 0.01 to 0.30 weight percent, or 0.01 to 0.25 weight percent, or 0.01 to 0.20 weight percent, or 0.01 to 0.10 weight percent, or 0.05 to 2.0 weight percent, or 0.05 to 1.0 weight percent, or 0.5 to 1.0 weight percent, or 0.05 to 0.40 weight percent, or 0.05 to 0.30 weight percent, or 0.05 to 0.25 weight percent, or 0.05 to 0.20 weight percent, or 0.05 to 0.10 weight percent.

Natural Thickener

The present compositions can also comprise an auxiliary nonionic or anionic polymeric thickening component, especially cellulose thickening polymers, especially a water-soluble or water dispersible polymeric materials, having a molecular weight greater than about 20,000. By "water-soluble or water dispersible polymer" is meant that the material will form a substantially clear solution in water at a 0.5 to 1 weight percent concentration at 25° C. and the material will increase the viscosity of the water either in the presence or absence of surfactant. Examples of water-soluble polymers which may desirably be used as an additional thickening component in the present compositions, are hydroxyethylcellulose, hydroxypropyl cellulose, hydroxypropyl methylcellulose, dextrans, for example Dextran purified crude Grade 2P, available from D&O Chemicals, carboxymethyl cellulose, plant exudates such as acacia, ghatti, and tragacanth, seaweed extracts such as sodium alginate, and sodium carrageenan. Preferred as the additional thickeners for the present compositions are natural polysaccharide or cellulose materials. Examples of such materials are guar gum, locust bean gum, and xanthan gum. Also suitable herein preferred is hydroxyethyl cellulose having a molecular weight of about 700,000. The thickeners are generally present in amounts of 0.05 to 2.0 weight percent, or 0.1 to 2.0 weight percent.

Dyes, Colorants, and Preservatives

The cleaning compositions optionally contain dyes, colorants and preservatives, or contain one or more, or none of these components. These dyes, colorants and preservatives can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, bisguanidine compounds (e.g. Dantagard and/or Glydant). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene. The compositions can additionally contain fluorescent whitening agents or blueing agents.

Adjuncts

The cleaning compositions optionally contain one or more of the following adjuncts: enzymes such as protease, amylase, and lipase, stain and soil repellants, lubricants, odor control agents, perfumes, fragrances and fragrance release agents, reducing agents such as sodium sulfite, and bleaching agents. Other adjuncts include, but are not limited to, acids, pH adjusting agents, electrolytes, dyes and/or colorants, solubilizing materials, stabilizers, thickeners, defoamers, hydrotropes, cloud point modifiers, preservatives, and other polymers. Electrolytes, when used, include, calcium, sodium and potassium chloride. Optional pH adjusting agents include inorganic acids and bases such as sodium hydroxide, and organic agents such as monoethanolamine, diethanolamine, and triethanolamine. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide.

In a suitable embodiment the compositions contain an effective amount one or more of the following enzymes: protease, lipase, amylase, cellulase, and mixtures thereof. Suitable enzymes are available from Novozymes®.

pH

The pH of the cleaning composition is measured at 10% dilution. The cleaning compositions can have a pH of between 7 and 13, between 2 and 13, or between 7 and 10, or between 7 and 9, or between 7.5 and 8.5.

Disinfectant or Sanitizer

The cleaning compositions contain no, or substantially no, additional disinfectants or sanitizers, such as quaternary ammonium antimicrobials or biguanides. Although the compositions may contain minor amounts of traditional antimicrobials as preservatives or other uses, the compositions are without the use of traditional quaternary ammonium compounds or phenolics. Non-limiting examples of these quaternary compounds include benzalkonium chlorides and/or substituted benzalkonium chlorides, di(C6-C14)alkyl di short chain (1-4 alkyl and/or hydroxyalkl) quaternary ammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylenzylmmonium chlorides, and mixtures thereof. Biguanide antimicrobial actives including, but not limited to polyhexamethylene biguanide hydrochloride, p-chlorohenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class.

Surface Modifying Agents

Although the compositions contain surfactants which lower the surface energy during cleaning, the compositions generally contain no surface modifying agents, which provide a lasting surface modification to the cleaning surface. The surface modifying agents are generally polymers other than the cellulosic thickening polymers and provide spreading of the water on the surface or beading of water on the surface, and this effect is seen when the surface is rewetted and even when subsequently dried after the rewetting. Examples of surface modifying agents include polymers and co-polymers of N,N-dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides. Other examples include organosilanes and organosilicone polymers, cationic polymers, hydrophobic amphoteric polymers, nanoparticles and hydrophobic organic polymers, such as waxes.

Cleaning Substrate

The cleaning composition is generally not impregnated in a cleaning substrate. Because of the limited number of ingredients, these compositions tend to perform better when used with a substrate at the time of application or use, and not sold as a pre-wetted substrate. Examples of unsuitable substrates include, nonwoven substrates, wovens substrates, hydroentangled substrates, foams and sponges and similar materials which can be used alone or attached to a cleaning implement, such as a floor mop, handle, or a hand held cleaning tool, such as a toilet cleaning device. The terms "nonwoven" or "nonwoven web" means a web having a structure of individual fibers or threads which are interlaid, but not in an identifiable manner as in a knitted web.

EXAMPLES

The compositions are simple, natural, high performance cleaning formulations with a minimum of essential natural ingredients. Competitive cleaners are either natural and inferior in performance or contain additional ingredients that make them non-natural, such as surfactants based on nonrenewable petrochemicals. Because preservatives, dyes and colorants are used in such small amounts, these may be synthetic and the entire composition may still be characterized as natural. Preferably, the compositions contain only natural preservatives, dyes, and colorants, if any.

Table I illustrates natural heavy duty cleaners of the invention. Table II illustrates less concentrated natural heavy duty cleaners of the invention. All numbers are in weight percent of active ingredients.

TABLE I

| Natural Heavy Duty Cleaners | A | B | C | D | E | F |
|---|---|---|---|---|---|---|
| Sodium lauryl sulfate | 16.6 | | 5.7 | | 10.0 | |
| MES[1] | | 11.1 | | | | 10.0 |
| Glucopon ® 600UP[2] | | | | 5.0 | 10.0 | |
| Glucopon ® 425N[3] | 7.8 | 8.0 | 2.7 | | | |
| Ammonyx LMDO[4] | 1.9 | 2.0 | 0.7 | | | |
| Ammonyx LO[5] | | | | | | 10.0 |
| AG 6206[6] | 2.9 | 1.0 | 1.0 | 2.0 | | |
| AG 6202[7] | | | | | 0.5 | 1.0 |
| Oleic Acid | 1.5 | 5.0 | 1.0 | | 0.5 | 1.0 |
| Sodium Citrate dihydrate | 3.0 | 6.0 | 2.0 | 2.0 | 1.0 | 1.0 |
| Sodium gluconate | | | | 1.0 | | |
| Boric acid | 1.5 | 1.5 | 3.0 | 3.0 | | 0.5 |
| Ca chloride | 0.1 | 0.1 | 0.1 | 0.1 | | 0.1 |
| Propylene glycol | 7.0 | 5.0 | | | | |
| Ethanol | | | 2.0 | | 5.0 | 2.0 |
| Glycerol | | | 8.0 | 10.0 | | |
| 1,3-Propane diol | | | | | | |
| Protease | 0.6 | 1.0 | 0.2 | 0.2 | 1.0 | 1.0 |
| Amylase | 0.3 | 0.6 | | | | |
| Sodium sulfite | | | 0.05 | | | |
| Dye | | | | | 0.1 | 0.1 |
| Preservative | 0.1 | 0.1 | 0.1 | 0.1 | 0.1 | 0.1 |
| FWA | | | | | 0.05 | |
| Thickener | | | 0.1 | 0.05 | | |
| Fragrance | 0.5 | 0.2 | 0.2 | 0.15 | 7.5 | 9.0 |
| NaOH to pH | 8.5 | 8.5 | 8.5 | 8.5 | | |
| Water | balance | balance | balance | balance | balance | balance |

[1]ALPHA-STEP ® MC-48 from Stepan Company.
[2]Coco glucoside from Cognis.
[3]from Cognis.
[4]from Lonza.
[5]from Lonza.
[6]from Akzo.
[7]from Akzo.

1. ALPHA-STEP® MC-48 from Stepan Company.
2. Coco glucoside from Cognis.
3. from Cognis.
4. from Lonza.
5. from Lonza.
6. from Akzo.
7. from Akzo.

TABLE II

| Natural Heavy Duty Cleaners | G | H | I | J | K | L |
|---|---|---|---|---|---|---|
| Sodium lauryl sulfate | 16.9 | | | | 17.5 | |

TABLE II-continued

| Natural Heavy Duty Cleaners | G | H | I | J | K | L |
|---|---|---|---|---|---|---|
| MES | | 11.1 | 14.0 | 14.0 | | |
| Glucopon ® 625N | | | 7.0 | 7.0 | | |
| Glucopon ® 425N | 8.0 | 8.0 | | | 8.0 | 4.0 |
| Ammonyx LMDO | 2.0 | 2.0 | | | | |
| AG 6206 | 3.0 | 1.0 | 3.0 | | | |
| Hexyl sulfate | | | | | 1.0 | 3.0 |
| Oleic Acid | | | 5.0 | 5.0 | | 0.5 |
| Glycerol monooleate | 1.5 | | | | | |
| Sorbitan monooleate | | 1.5 | | | 0.5 | |
| Sodium Citrate dihydrate | | | 6.0 | 6.0 | | |
| Ca chloride | | | 0.1 | 0.1 | | |
| NaCl | | | 1.0 | 1.0 | 1.0 | 0.5 |
| Propylene glycol | | | 5.0 | 5.0 | | |
| Glycerol | 1.0 | | | | | |
| 1,3-Propane diol | | 1.0 | | | 3.0 | 3.0 |
| Preservative | 0.1 | 0.1 | 0.1 | 0.1 | | |
| Fragrance | | 0.2 | | | 0.1 | 0.1 |
| NaOH to pH | 8.5 | 8.5 | 8.5 | 8.5 | 10.0 | 7.0 |
| Water | balance | balance | balance | balance | balance | balance |

Formula A was compared for laundry wash performance with a leading commercial liquid laundry detergent containing non-natural ingredients. Stain removal was tested by washing coffee, tea, red wine, chocolate pudding, and gravy stains applied to four replicates of 100% cotton fabric at water of 93 F and 100 ppm hardness in a 12-minute wash cycle in a Whirlpool top-load washing machine and reflectance of the stains via the L,a,b scale was then converted to a stain removal percentage. Formula A was superior to commercial detergent on coffee, tea, red wine, chocolate pudding, and gravy.

Formula D was compared for pretreatment performance against a leading commercial pretreatment product containing non-natural ingredients. Formulas were evaluated in a wash study using hand applied stains on pre-scoured white cotton T-shirts. 5 mL of product was pipetted onto each stain, allowed to sit for 5 minutes, and then washed in hot water with Tide® liquid detergent and dried in a standard drier. Formula D was parity of several stains and superior to the commercial pretreatment product on wine stain.

Table III illustrates the effect of the hydrophilic syndetic in lowering the interfacial tension (IFT) of the composition for improved performance. Interfacial tension of the formulations at use dilution in the presence of 100 ppm hardness against canola oil was measured using a spinning drop tensiometer at room temperature. Composition I with the hydrophilic syndetic AG6206 achieves a lower IFT at faster times than Composition J, which doesn't have AG6206, and much faster that the commercial detergent ALL®.

TABLE III

| | IFT, 2 min | IFT, 7 min | IFT 12 min |
|---|---|---|---|
| Compositon I | 0.20 | 0.18 | 0.22 |
| Composition J | 0.26 | 0.25 | 0.28 |
| All Detergent | 0.46 | 0.32 | 0.51 |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A natural heavy duty cleaning composition consisting essentially of:

a. an anionic surfactant selected from the group consisting of sodium lauryl sulfate, sodium alkyl α-sulfomethyl ester, and combinations thereof;

b. a hydrophilic syndetic selected from C6 alkylpolyglucoside;

c. a nonionic surfactant selected from the group consisting of C12 amine oxide, C12-14 amine oxide, C12 amidoamine oxide, C12-14 amidoamine oxide, alkylpolyglucosides having chain lengths greater than C8, and combinations thereof, d. a solvent selected from the group consisting of propylene glycol, 1,3-propanediol, ethanol, sorbitol, glycerol and combinations thereof, e. a hydrophobic syndetic selected from a fatty acid;

f. pH 7-13;

g. optionally an organic chelating agent from the group consisting of 2-hydroxyacids, 2-hydroxyacid derivatives, glutamic acid, glutamic acid derivatives, and mixtures thereof; and h. optional ingredients selected from glycerol, pH adjusting agents, calcium salts, boric acid or borate, enzymes, dyes, colorants, fragrances, preservatives, fluorescent whitening agents, blueing agents, defoamers, bleaches, thickeners.

2. The composition of claim 1, wherein the composition does not contain alkylglycol ethers, alcohol alkoxylates, alkyl monoglycerolether sulfate, or alkyl ether sulfates.

3. The composition of claim 1, wherein the solvent is propylene glycol.

4. The composition of claim 1, wherein the solvent is ethanol.

5. The composition of claim 1, wherein the anionic surfactant is sodium lauryl sulfate.

6. The composition of claim 1, wherein the anionic surfactant is sodium alkyl α-sulfomethyl ester.

7. The composition of claim 1, wherein the fatty acid has a primary chain length from C10 to C18.

8. The composition of claim 1, wherein the composition contains an organic chelating agent from the group consisting of 2-hydroxyacids, 2-hydroxyacid derivatives, glutamic acid, glutamic acid derivatives, and mixtures thereof.

9. A natural heavy duty cleaning composition consisting essentially of:

a. an anionic surfactant selected from the group consisting of a fatty alcohol sulfate, an alkyl α-sulfomethyl ester, a disodium α-sulfo fatty acid salt and combinations thereof, b. a hydrophilic syndetic selected from the group consisting of C6 alkylpolyglucoside, C6 to C8 alkylpolyglucoside, C8 alkylpolyglucoside, C6 to C8 alkyl sulfate and combinations thereof, c. a nonionic surfactant selected from the group consisting of an amine oxide, an alkoxylated amine, alkylpolyglucoside having chain lengths from C8 to C20, sarcosinate, tauride, betaine, sulfobetaine, alkyldiethanolamide, alkylethanolamide, and combinations thereof, d. a solvent selected from the group consisting of propylene glycol, 1,3-propanediol, ethanol, sorbitol, glycerol and combinations thereof, e. a hydrophobic syndetic selected from the group consisting of a fatty acid, a fatty alcohol, a sterol, a sorbitan fatty acid ester, a glycerol fatty acid ester, and combinations thereof, f. optionally an organic chelating agent from the group consisting of 2-hydroxyacids, 2-hydroxyacid derivatives, glutamic acid, glutamic acid derivatives, and mixtures thereof, and g. optional ingredients selected from glycerol, pH adjusting agents, alkanolamines, calcium salts, boric acid, enzymes, dyes, colorants, fragrances, preservatives, fluorescent whitening agents, blueing agents, defoamers, bleaches, thickeners.

10. The composition of claim 9, wherein the composition does not contain glycol ethers or alcohol alkoxylates or monoglycerolether sulfate.

11. The composition of claim 9, wherein the solvent is propylene glycol.

12. The composition of claim 9, wherein the solvent is ethanol.

13. The composition of claim 9, wherein the anionic surfactant is sodium lauryl sulfate.

14. The composition of claim 9, wherein the anionic surfactant is sodium alkyl α-sulfomethyl ester.

15. The composition of claim 9, wherein hydrophobic syndetic is a fatty acid.

16. The composition of claim 9, wherein the fatty acid has a primary chain length from C10 to C20.

17. The composition of claim 9, wherein the hydrophobic syndetic is a sorbitan fatty acid ester.

18. The composition of claim 9, wherein the hydrophobic syndetic is a glycerol fatty acid ester.

19. The composition of claim 9, wherein the hydrophilic syndetic is an alkylpolyglucoside.

20. The composition of claim 9, wherein the hydrophilic syndetic is an alkyl sulfate.

21. A natural heavy duty cleaning composition comprising:

a. an anionic surfactant selected from the group consisting of sodium lauryl sulfate, sodium alkyl α-sulfomethyl ester, disodium α-sulfo fatty acid salt and combinations thereof, b. a hydrophilic syndetic selected from the group consisting of C6 alkylpolyglucoside, C6 to C8 alkylpolyglucoside, C8 alkylpolyglucoside, C6 to C8 alkyl sulfate and combinations thereof, c. a nonionic surfactant selected from the group consisting of amide oxide, alkylpolyglucoside having chain lengths from C8 to C16, and combinations thereof, d. a solvent selected from the group consisting of propylene glycol, 1,3-propanediol, ethanol, sorbitol, glycerol and combinations thereof, and e. a hydrophobic syndetic selected from the group consisting of a fatty acid, a fatty alcohol, a sterol, a sorbitan fatty acid ester, a glycerol fatty acid ester, and combinations thereof.

22. The composition of claim 21, wherein the hydrophilic syndetic is a C6 alkylpolyglucoside.

23. The composition of claim 21, wherein the solvent is glycerol.

24. The composition of claim 21, wherein the hydrophobic syndetic is a glycerol fatty acid ester.

25. The composition of claim 21, wherein the hydrophobic syndetic is a sorbitan fatty acid ester.

* * * * *